US007201087B2

(12) United States Patent
Chen

(10) Patent No.: US 7,201,087 B2
(45) Date of Patent: Apr. 10, 2007

(54) MULTI-FUNCTIONAL TOOL HEAD

(76) Inventor: Chang-Ying Chen, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 11/220,193

(22) Filed: Sep. 6, 2005

(65) Prior Publication Data

US 2007/0051216 A1 Mar. 8, 2007

(51) Int. Cl.
*B25B 23/00* (2006.01)

(52) U.S. Cl. ..... 81/438; 81/177.85; 279/79

(58) Field of Classification Search ..... 81/437–439, 81/177.85, 177.2; 279/137, 76, 79
See application file for complete search history.

(56) References Cited

U.S. PATENT DOCUMENTS 386,263 A * 7/1888 Pedersen ..... 279/42
985,135 A * 2/1911 Bigelow ..... 279/79
1,433,163 A * 10/1922 Walters ..... 81/124.6
1,814,274 A * 7/1931 Williamson ..... 279/79
2,805,594 A * 9/1957 Fogel ..... 81/125
4,266,453 A * 5/1981 Farley ..... 81/177.85
6,363,819 B1 * 4/2002 Li ..... 81/438
6,840,143 B1 * 1/2005 Lin ..... 81/438
6,860,178 B2 * 3/2005 Wang ..... 81/177.2
2004/0255732 A1 * 12/2004 Lin ..... 81/438
2006/0191384 A1 * 8/2006 Dougherty ..... 81/177.2

* cited by examiner

*Primary Examiner*—D. S. Meislin

(57) ABSTRACT

A multi-functional tool head comprises a supporting unit having a polygonal shape; an end of the supporting unit being installed with a receiving seat recess for receiving an opener head; a penetrating hole being formed in the annular trench; the penetrating hole being communicated to the receiving seat recess; a buckle capable of being inserted into the penetrating hole; one end of the buckle being bent inwards so as to form with a resisting portion for inserting into the penetrating hole. If a screw opener head is used, the opener head can be inserted into the supporting unit; the buckle will resist against the opener head so as to combine the opener head to the supporting unit. If the present invention is to be used with a socket, the socket sleeves around the polygonal supporting unit; and the part of the buckle exposed from the annular trench will buckle the socket.

1 Claim, 6 Drawing Sheets

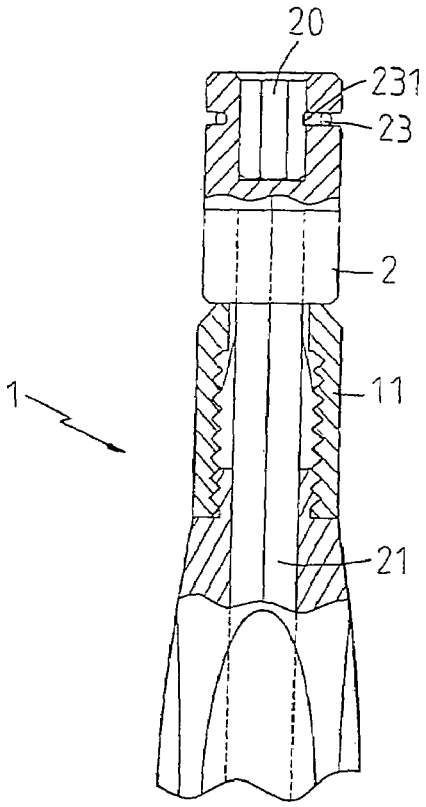
FIG. 3-b
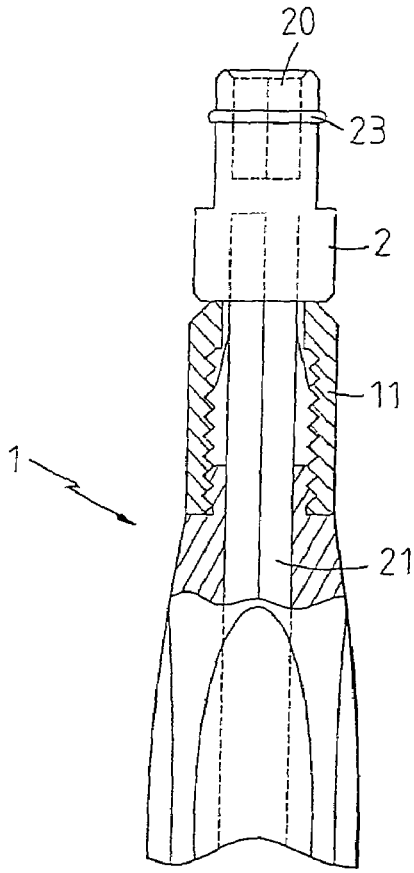
FIG. 3-c
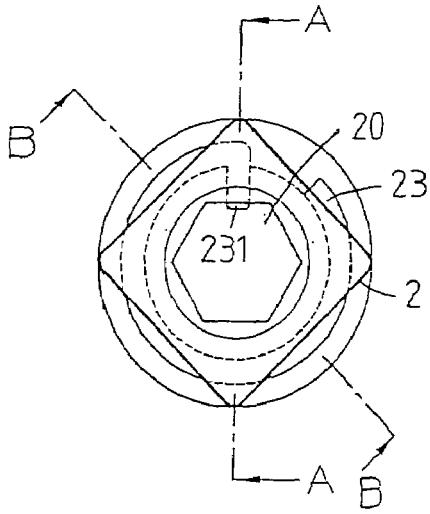
FIG. 3-a

MULTI-FUNCTIONAL TOOL HEAD

FIELD OF THE INVENTION

The present invention relates to driving tools, and in particular to a multi-functional tool head, which can be engaged to a screw opener head for driving a screw and a socket as a socket spanner.

BACKGROUND OF THE INVENTION

Openers and socket spanners are different tools for driving threaded devices. A socket spanner can refer to FIG. 5 and an opener is illustrated in FIG. 4. Openers and sockets are frequently used in works.

However conventionally, the openers and socket are two different tools. The user must take or prepare two different kinds of tools for working. The prior art tool is only suitable for updating different heads, but they are only used to update same kinds of tools. For example the tool body is suitable for different opener heads of different sizes or specifications. There is no tool which is suitable for the sockets and opener heads.

In one improvement, an opener is installed with a sleeve unit for receiving a sleeve body of an opening head. A front end of the sleeve body is formed with a hexagonal inserting hole. The sleeve unit is movable axially so as to be engaged to the inserting hole of the sleeve body. Thereby the sleeve body can be assembled to or detached from the opener. However in operation, the user must slide the sleeve unit downwards by one hand and takes out the opener head by another hand. As result, the user cannot hold the screw opener tightly so that the opener releases. Moreover the sleeve unit has an annular structure. It is inconvenient to assemble the sleeve unit to the sleeve body, and thus the manufacturing efficiency is low. More importantly, the hand tool is only used with various opening heads with the sleeve body, but it cannot be used with socket structure. Thereby the use of the prior art is also confined. The user still requires to prepare the socket spanners and openers.

SUMMARY OF THE INVENTION

Accordingly, the primary object of the present invention is to provide a multi-functional tool head, which can be engaged to a screw opener head for driving a screw and a socket as a socket spanner.

To achieve above objects, the present invention provides a multi-functional tool head which comprises a supporting unit having a polygonal shape; an end of the supporting unit being installed with a receiving seat recess for receiving an opener head; an penetrating hole being formed in the annular trench; the penetrating hole being communicated to the receiving seat recess; a buckle capable of being inserted into the penetrating hole; one end of the buckle being bent inwards so as to form with a resisting portion for inserting into the penetrating hole. If a screw opener head is used, the opener head can be inserted into the supporting unit; the buckle will resist against the opener head so as to combine the opener head to the supporting unit. If the present invention is to be used with a socket, the socket sleeves around the polygonal supporting unit; and the part of the buckle exposes from the annular trench will buckle to the socket.

The various objects and advantages of the present invention will be more readily understood from the following detailed description when read in conjunction with the appended drawing.

BRIEF DESCRIPTION OF THE DRAWINGS

FIG. 3*a* is an elevational view of the multi-functional tool head of the present invention.

FIG. 3*b* is a cross sectional view along line A—A of the multi-functional tool head of the present invention.

FIG. 3*c* is a cross sectional view along line B—B of the multi-functional tool head of the present invention.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
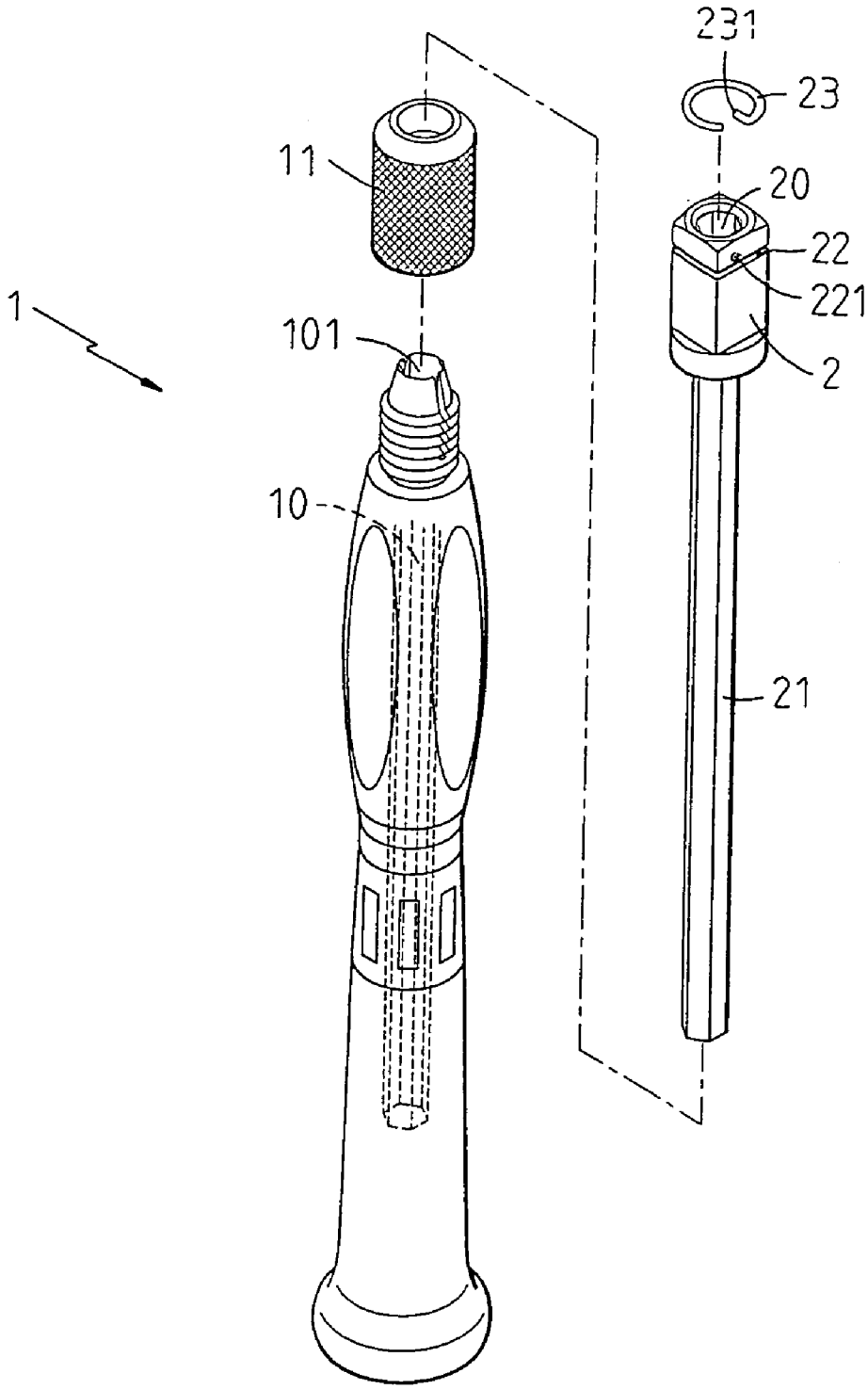
FIG. 1 is an exploded perspective view of the multi-functional tool head of the present invention.
Figure 2:
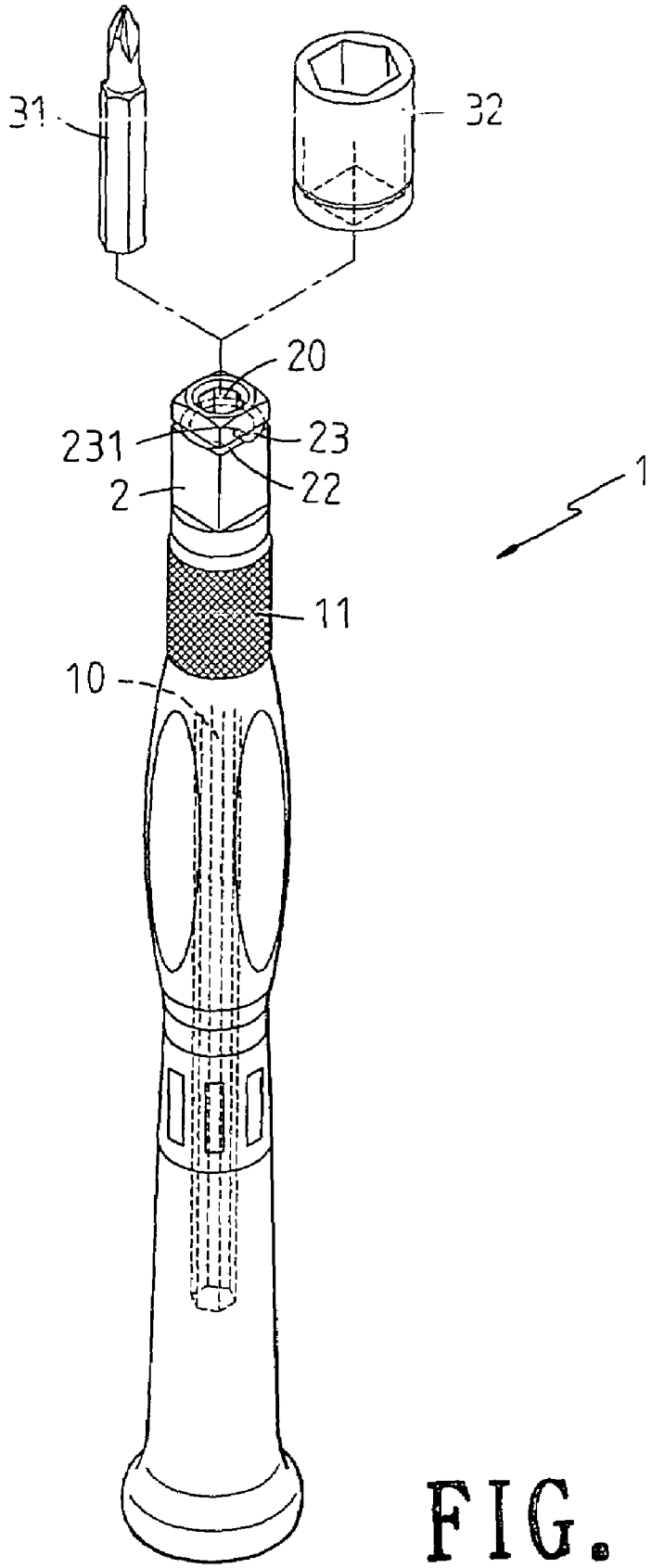
FIG. 2 is an assembled schematic view about the multi-functional tool head of the present invention.

Referring to FIGS. 1 to 3, the multi-functional tool head of the present invention is illustrated. The present invention has the following elements.

A tool body 1 is a holdable body. The tool body 1 is formed with a receiving space 10 therein. The receiving space 10 has a shape of long cylinder. One end of the receiving space 10 has an opening 101.

A supporting unit 2 has a polygonal shape. In this embodiment, the supporting unit 2 has a rectangular shape, but the present invention is not confined to this shape. A combining rod 21 extended from the supporting unit 2 is received in the opening 101 of the receiving space 10 by using a locking unit 11. The combination of the supporting unit 2 to the opening 101 of the receiving space 10 is known in the prior art and thus the detail will not be further described herein. A socket 32 sockets around the supporting unit 2. An upper end of the supporting unit 2 is formed with a hexagonal receiving seat recess 20 for receiving an opener head 31. A lower end of the supporting unit 2 is extended with the combining rod 21. The combining rod 21 can insert into the receiving space 10 of the tool body 1 for enhancing the combination strength between the supporting unit 2 and the tool body 1. An outer periphery of the supporting unit 2 has an annular trench 22 near an upper end of the supporting unit 2. A penetrating hole 221 is formed in the supporting unit 2 above the annular trench 22. The penetrating hole 221 is communicated to the receiving seat recess 20.

Figure 4:
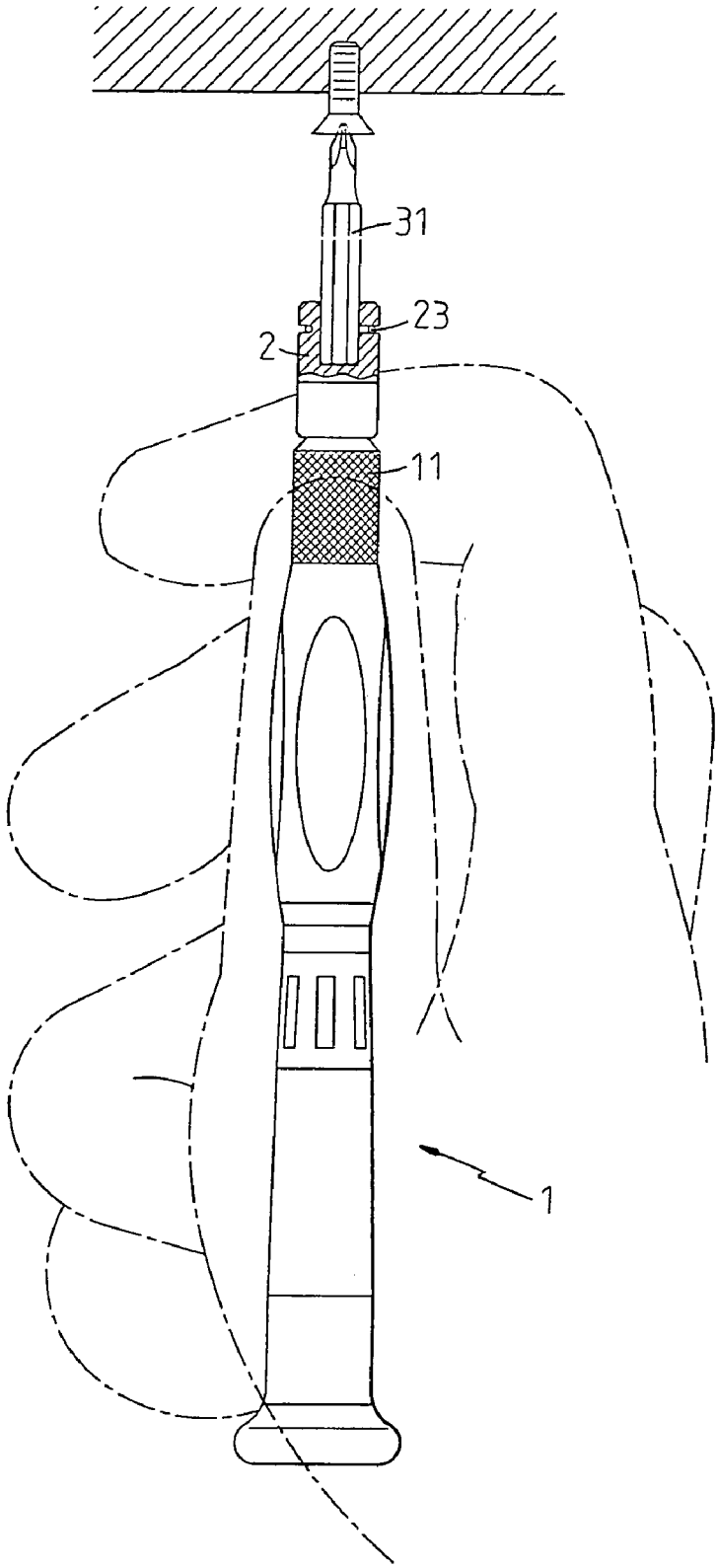
FIG. 4 is a schematic view showing the use of the multi-functional tool head of the present invention.
Figure 5:
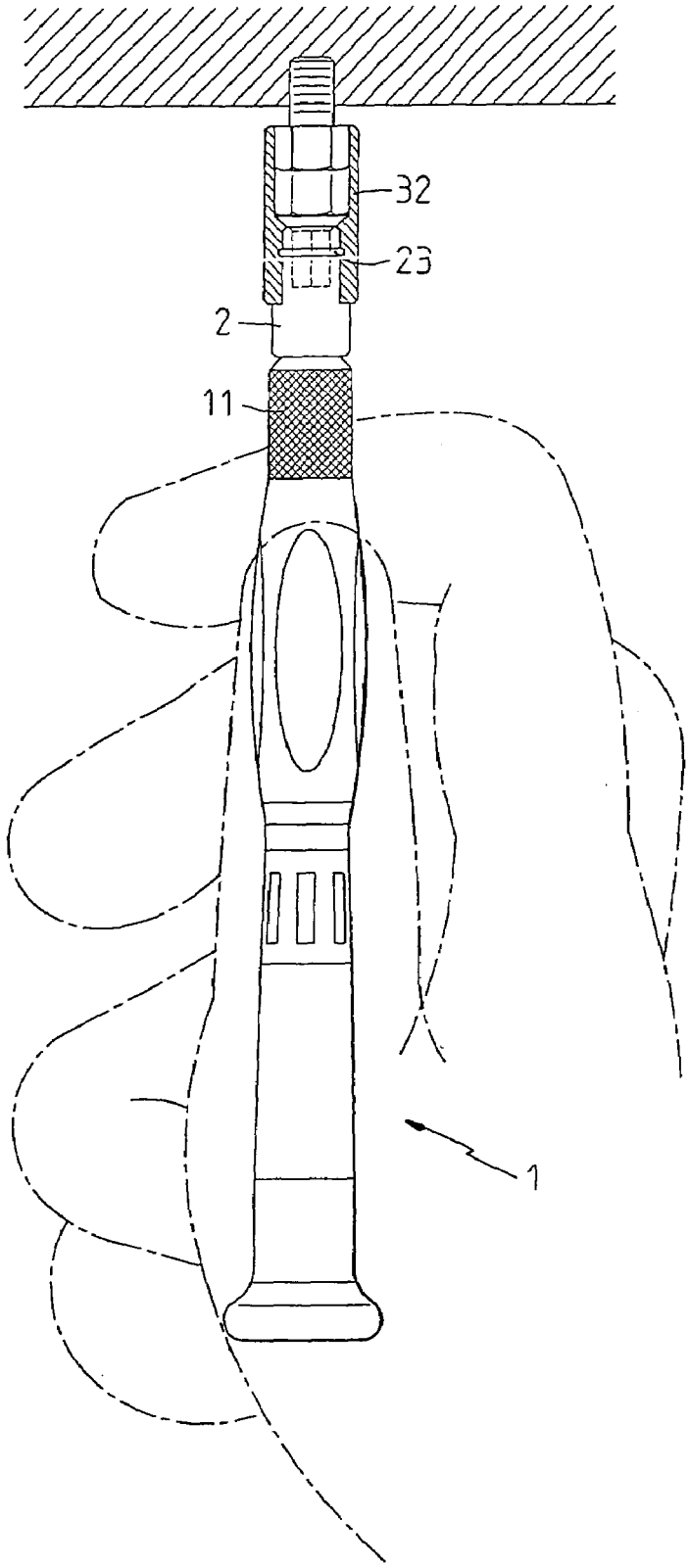
FIG. 5 is another schematic view showing the use of the multi-functional tool head of the present invention.

A buckle 23 can insert into the penetrating hole 221 and the annular trench 22. The buckle 23 is elastic and has a C shape. One end of the buckle 23 is bent inwards so as to form with a resisting portion 231 for inserting into the penetrating hole 221. Since the buckle 23 has a C shape, it can enclose the annular trench 22, a part of the resisting portion 231 exposes out of the annular trench 22, as shown in FIG. 3. If an opener head 31 is used, the opener head 31 can be inserted into the supporting unit 2. The buckle 23 will resist against the opener head 31 so as to combine the opener head 31 to the supporting unit 2. Thus the tool body 1 can drive a screw unit (referring to FIG. 4). If the present invention is to be used with a socket 32, the socket 32 can sleeve around the polygonal supporting unit 2. The part of the buckle 23 exposed from the annular trench 22 will buckle the socket 32. When the socket 32 is assembled, the tool body 1 can be used to drive a screw unit, as shown in FIG. 5.

In the present invention, in assembling or detaching the opener head 31 or the socket 32, only slight force is necessary for detaching or assembling operation. Thus, the assembly work is easily. The structure of the supporting unit 2 is simple. Only one buckle 23 is used. Thereby the efficiency is manufacture in high.

Figure 7:
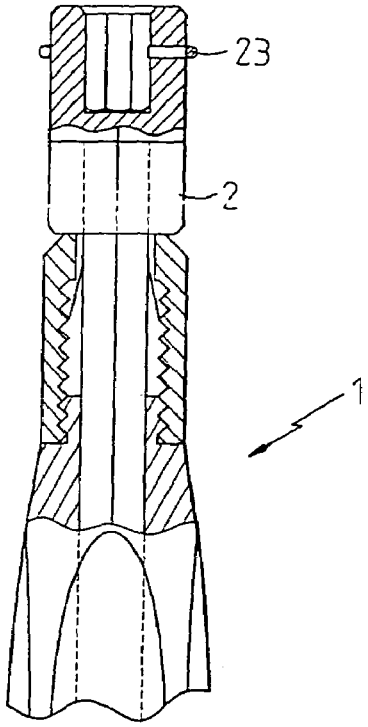
FIG. 7 is a longitudinal schematic view about the second embodiment of the present invention.
Figure 6:
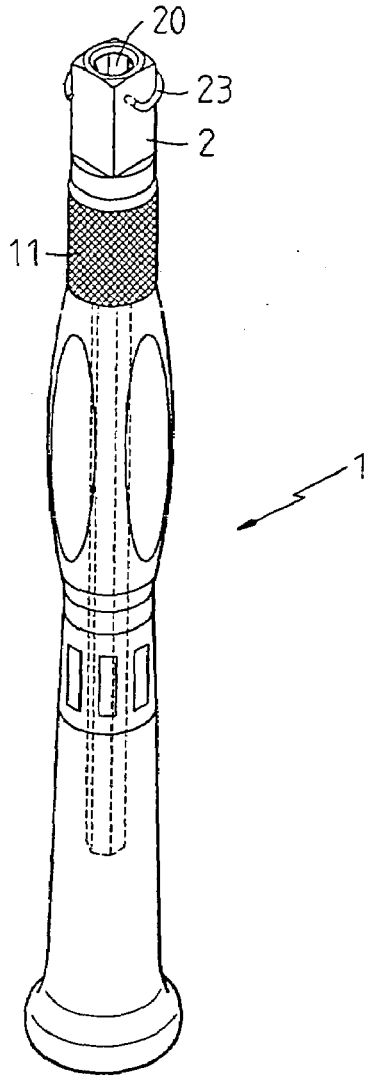
FIG. 6 is a perspective view about the second embodiment of the present invention.
Figure 8:
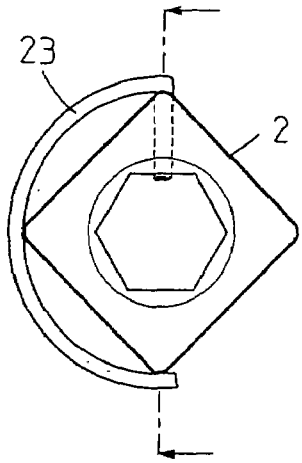
FIG. 8 is an elevational view of the second embodiment of the present invention.

Referring to FIGS. 6 to 8, the second embodiment of the present invention is illustrated. Those identical to the first embodiment will not be described herein. Only these different are described herein. In the present invention, the supporting unit 2 has no annular trench. The buckle 23 sleeves the supporting unit 2 directly. However the same effect as that in the first embodiment can be achieved.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A multi-functional tool head comprising:

a supporting unit having a polygonal shape, a front end of the supporting unit having a receiving seat recess for receiving a drive bit; a through hole being formed in the supporting unit; the through hole being communicated with the receiving seat recess; an annular groove in the supporting unit;

a spring clip inserted into the through hole; a part of the spring clip exposed from the through hole to an exterior of the supporting unit; one end of the spring grip being bent inwards so as to from a clip portion inserted into the through hole and into the receiving seat recess;

a drive bit for insertion into the supporting unit; the spring clip for engagement with the driving bit to hold the driving bit in the supporting unit;

a socket spanner, the socket spanner sleeves around the polygonal supporting unit; and the part of the spring clip exposed from the annular groove in the supporting unit will hold the socket on the supporting unit;

wherein said drive bit or said socket spanner is enagaeable with the supporting unit.

* * * * *